US010758030B2

(12) United States Patent
Anderson

(10) Patent No.: US 10,758,030 B2
(45) Date of Patent: Sep. 1, 2020

(54) BACKPACK STRAP APPARATUS AND METHOD OF USE

(71) Applicant: Rhea N. Anderson, Parkville, MO (US)

(72) Inventor: Rhea N. Anderson, Parkville, MO (US)

( * ) Notice: Subject to any disclaimer, the term of this patent is extended or adjusted under 35 U.S.C. 154(b) by 0 days.

(21) Appl. No.: 16/183,891

(22) Filed: Nov. 8, 2018

(65) Prior Publication Data

US 2019/0133302 A1 May 9, 2019

Related U.S. Application Data

(60) Provisional application No. 62/583,268, filed on Nov. 8, 2017.

(51) Int. Cl.
*A45F 3/04* (2006.01)

(52) U.S. Cl.
CPC ..... *A45F 3/047* (2013.01)

(58) Field of Classification Search
CPC . Y10T 24/318; Y10T 24/1498; Y10T 24/316; A45F 3/047; B65H 54/585; B65H 75/406; A63B 23/14; B62M 3/083
USPC ..... 24/115 L, 115 A; 242/437.4, 475.7, 360
See application file for complete search history.

(56) References Cited

U.S. PATENT DOCUMENTS 4,351,526 A * 9/1982 Schwartz ..... A63B 21/0726 482/105
5,033,740 A * 7/1991 Schwartz ..... A63B 21/072 482/105
6,318,612 B1 * 11/2001 MacNeil ..... B60R 9/048 224/330
6,896,458 B1 * 5/2005 Romero ..... B60P 7/0823 410/100
7,039,958 B2 5/2006 Henricksen
7,124,975 B2 * 10/2006 Richardson ..... B65H 75/366 242/402
7,658,027 B2 2/2010 Jain et al.
8,007,416 B2 * 8/2011 Arlie ..... A63B 21/075 482/106
8,210,461 B1 * 7/2012 Strope ..... B65H 54/585 242/395
8,955,201 B2 * 2/2015 Bogoslofski ..... A45F 5/00 24/300
9,216,704 B2 * 12/2015 Morris ..... B60R 16/0215
D825,487 S * 8/2018 Munson ..... D13/155
2004/0000570 A1 * 1/2004 Forsman ..... A45F 3/047 224/579
2004/0058121 A1 3/2004 Schriefer et al.
2004/0202520 A1 * 10/2004 Guenther ..... B60P 7/0846 410/103
2008/0276432 A1 * 11/2008 McNeill ..... B65D 63/1027 24/16 PB (Continued)

*Primary Examiner* — Adam J Waggenspack
(74) *Attorney, Agent, or Firm* — Law Office of Mark Brown, LLC; Christopher M. DeBacker

(57) ABSTRACT

A backpack strap spool for rolling up an excess length of a backpack strap. A roller is rolled against the backpack strap, allowing it to be rolled into a tight roll next to the arm loop of the backpack. A loop is connected to end tabs of the roller and restrains the strap against the roller. The loop has several holes to adjust the tightness of the loop against the strap and roller, preventing the strap from becoming unrolled. Accessories may be clipped or inserted into the unused holes of the loop.

8 Claims, 8 Drawing Sheets

(56) References Cited

U.S. PATENT DOCUMENTS

| | | | | |
|---|---|---|---|---|
| 2010/0031477 | A1* | 2/2010 | Harrison | B60P 7/0846 24/115 G |
| 2016/0225292 | A1 | 8/2016 | Maltas et al. | |

* cited by examiner

BACKPACK STRAP APPARATUS AND METHOD OF USE

CROSS-REFERENCE TO RELATED APPLICATION

This application claims priority in U.S. Provisional Patent Application No. 62/583,268 Filed Nov. 8, 2017, which is incorporated herein by reference.

BACKGROUND OF THE INVENTION

1. Field of the Invention

The present invention relates generally to a backpack strap spool and method for use thereof, and more specifically to a backpack strap spool for rolling excess backpack straps.

2. Description of the Related Art

Backpacks often have excess straps hanging from the shoulder straps. This is especially prominent for children. The excess straps can get caught on objects, doors, and could even potentially trip the user. What is needed is a simple way to store excess backpack straps.

Heretofore there has not been available a system or method for a backpack strap apparatus with the advantages and features of the present invention.

BRIEF SUMMARY OF THE INVENTION

The present invention generally provides a backpack strap spool apparatus for rolling up excess backpack straps to get them out of the way and prevent accidents. A roller is placed against the end of the backpack strap and the strap is rolled up against the roller. A loop is connected to the roller by a pair of end tabs connected to the ends of the roller. The loop restrains the strap against the roller and prevents it from becoming unrolled.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Backpack Strap Spool Apparatus 2

Figure 1:
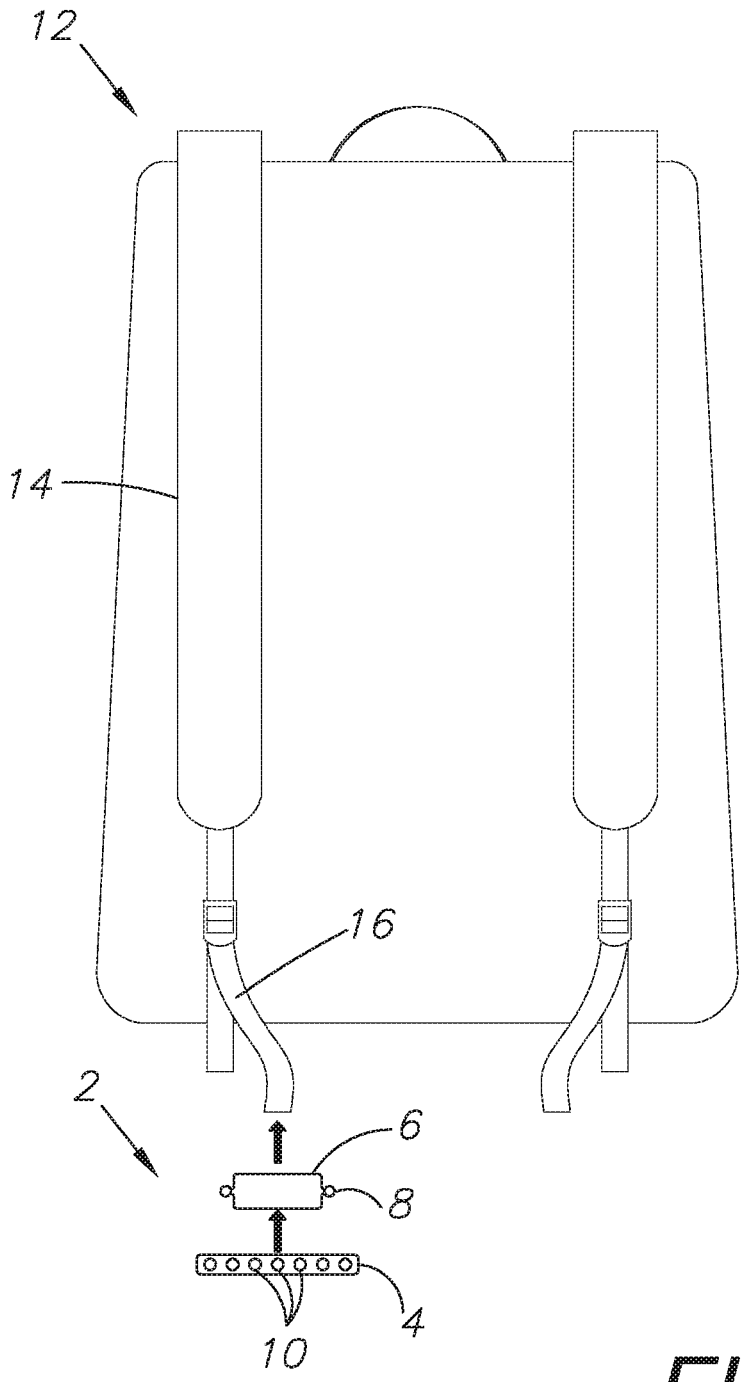
FIG. 1 is a front elevational view of a typical backpack environment showing an embodiment of the present invention in a first, un-installed orientation.
Figure 2:
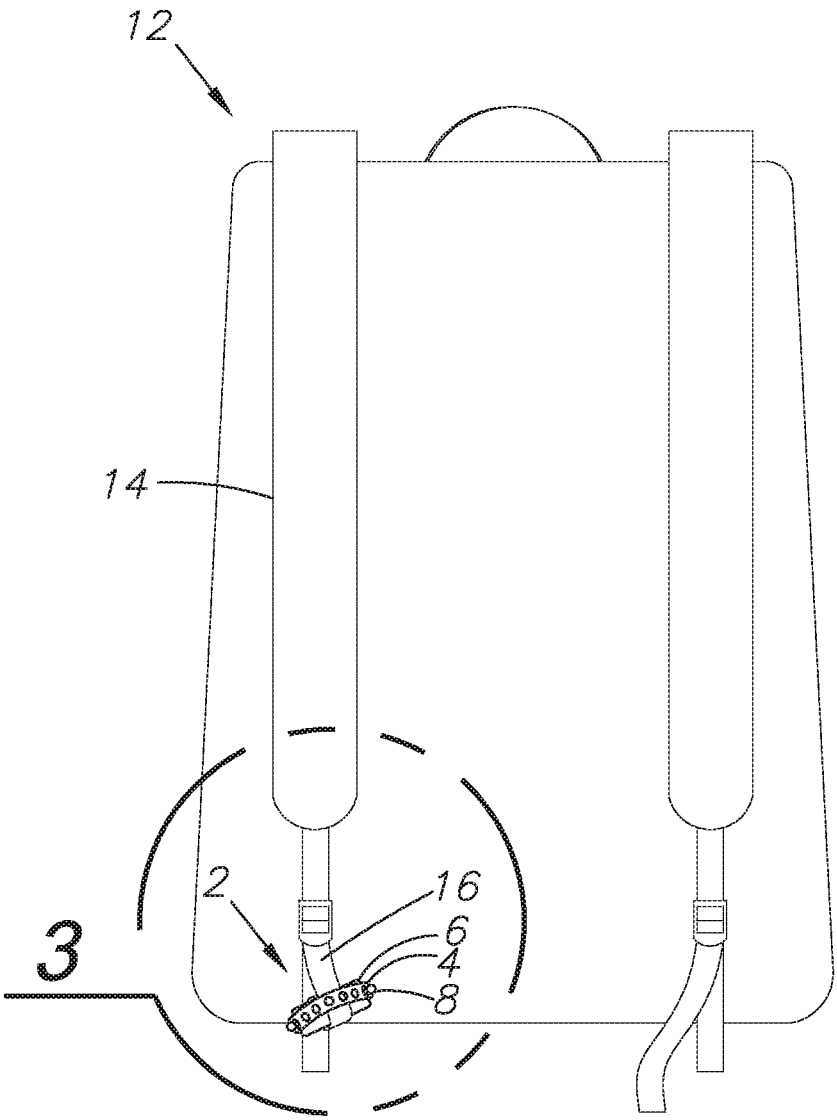
FIG. 2 is a front elevational view thereof, showing an embodiment of the present invention in a second, installed orientation.
Figure 3:
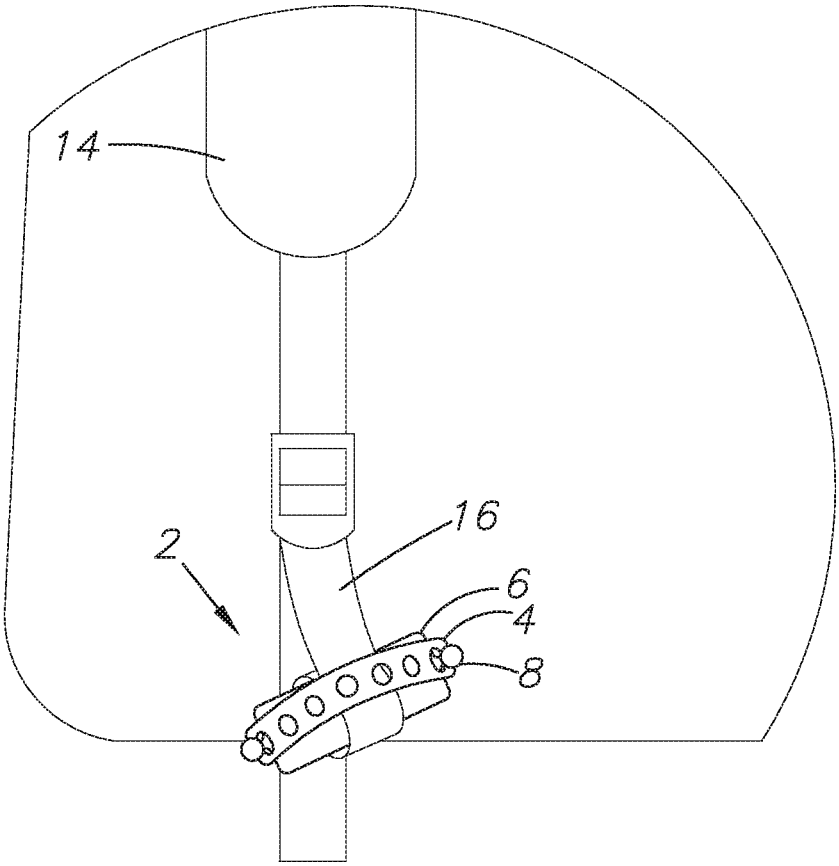
FIG. 3 is a detailed view taken about the circle of FIG. 2.
Figure 4:
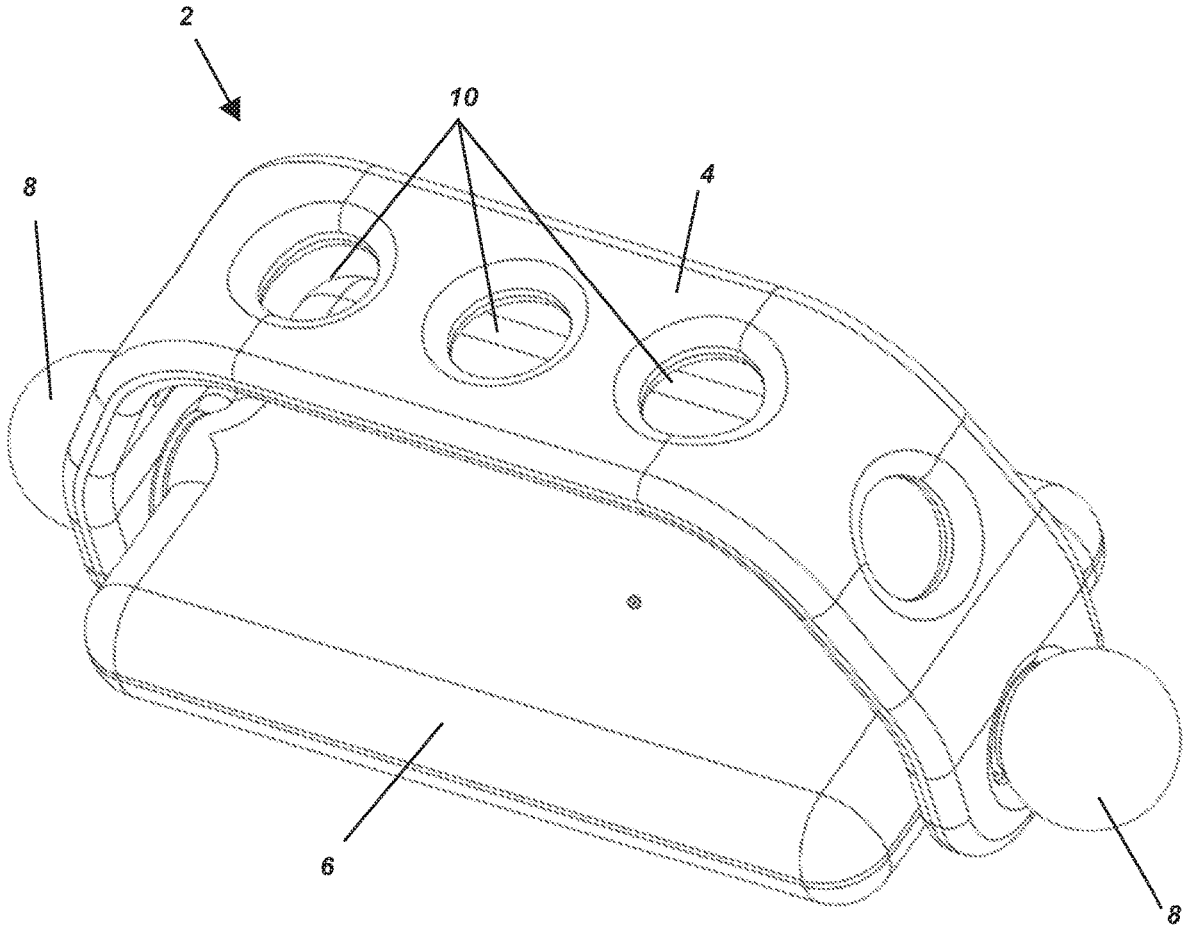
FIG. 4 is a three-dimensional isometric view of a preferred embodiment of the present invention in an assembled state.
Figure 5:
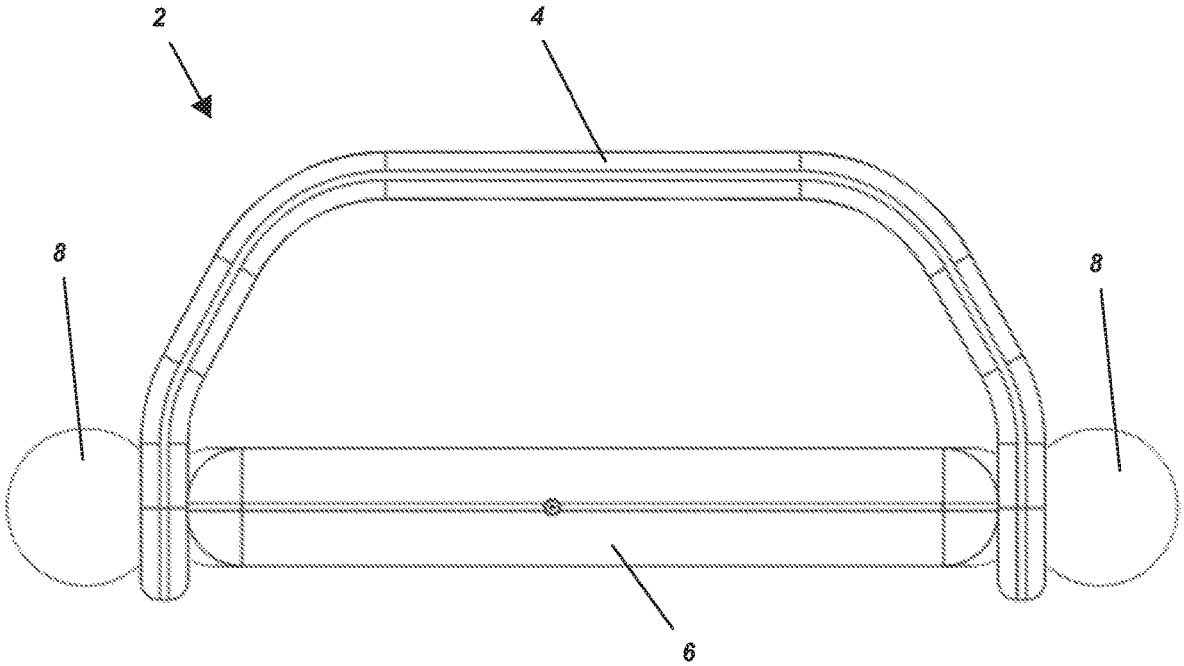
FIG. 5 is a front elevational view thereof.
Figure 6:
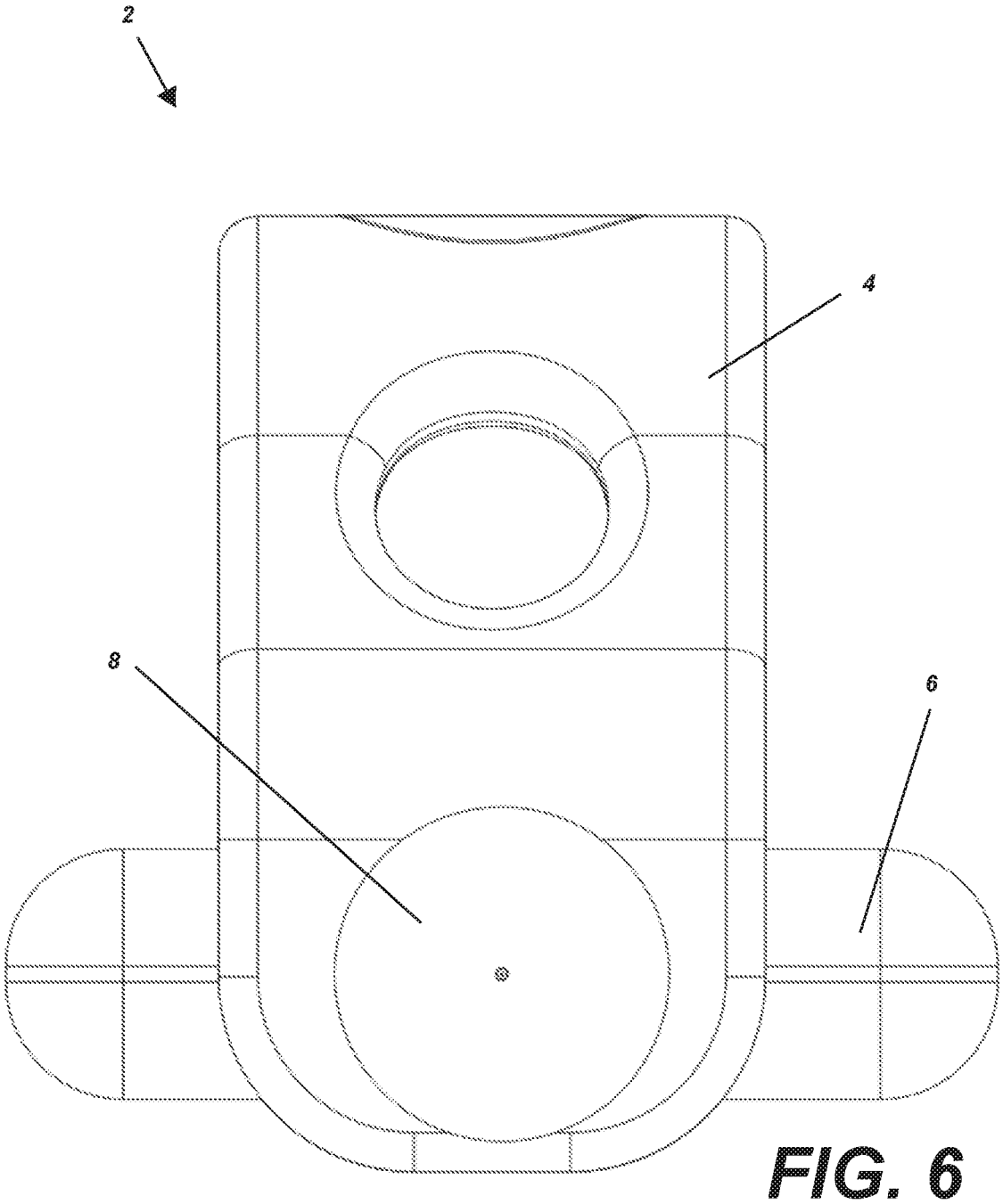
FIG. 6 is a side elevational view thereof.
Figure 7:
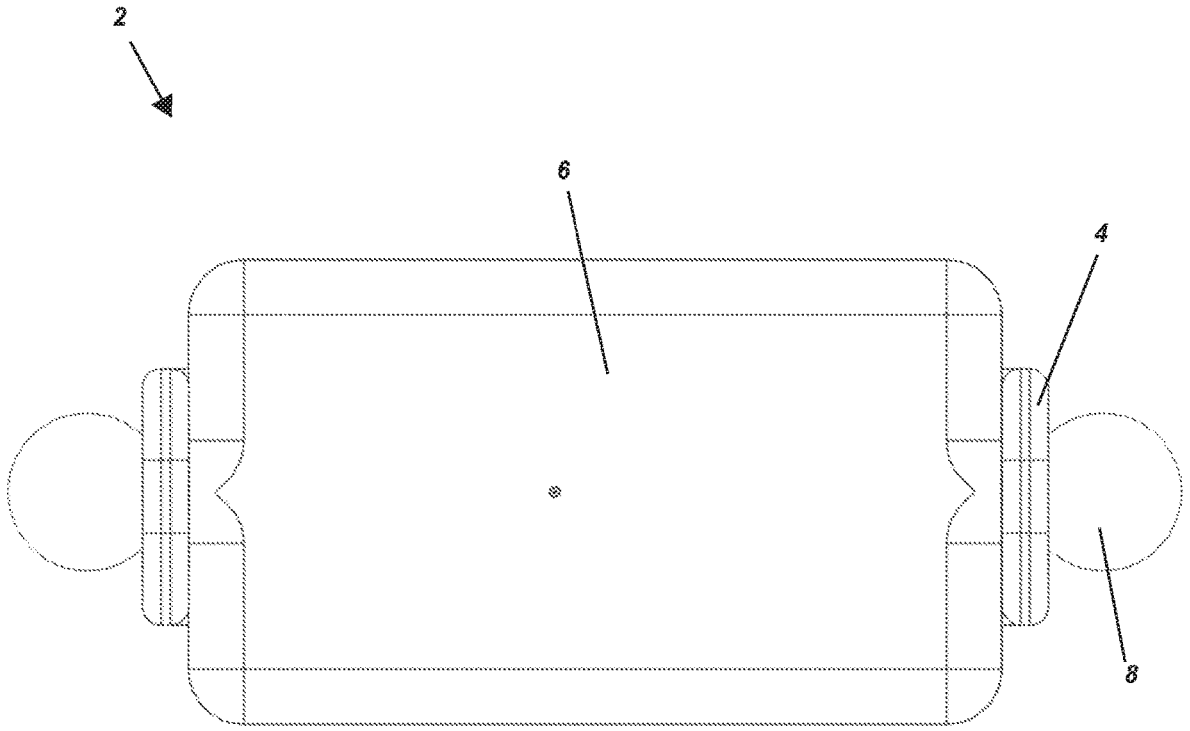
FIG. 7 is a bottom plan view thereof.
Figure 8:
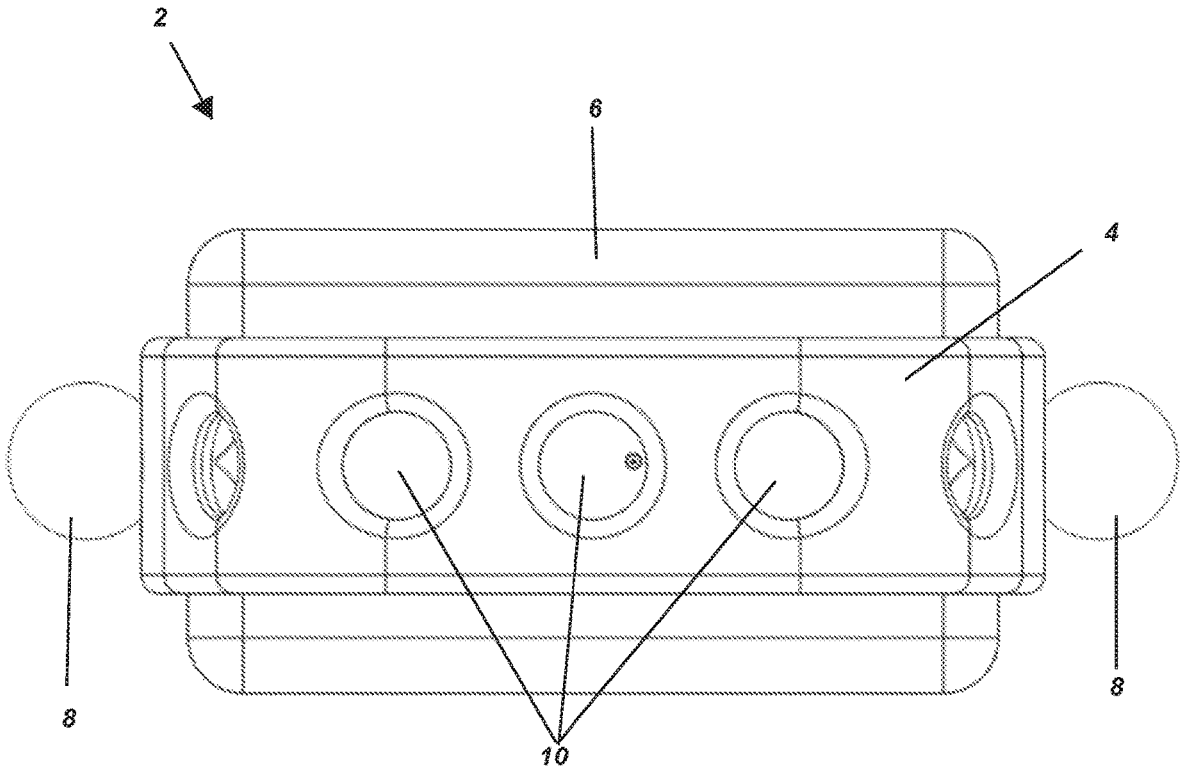
FIG. 8 is a top plan view thereof.

Referring to the figures, FIG. 1 shows a backpack strap spool 2 which includes a roller 6 for engaging excess backpack straps 16 and a loop 4 for rolling up the excess backpack strap about the roller. The excess straps 16 come from tightening the arm loops 14 of a backpack 12, especially for small children who need to tighten the straps further than an adult would, resulting in long excess straps 16. The roller 6 would be placed flat against the excess backpack strap 16 and the spool 2 could be used to roll up and secure the strap using the loop 4. This prevents the excess backpack strap material from hanging down, getting in the way, and potentially getting caught on objects or tripping the user.

The loop 4 includes a plurality of holes 10 for connecting to the tabs 8 on either end of the roller 6. This allows the loop 4 to be tightened or loosened as need to accommodate the excess strap 16 when rolled.

The apparatus would likely be formed from plastic and/or metal elements. The loop 4 can easily be removed from one of the tabs 8 to unroll the strap as well for quick removal from the backpack. The holes 10 can also be used to attach accessories. The various holes 10 allow the spool to securely stretch and hold the backpack strap at the desired location.

As shown in FIGS. 4-8, the roller 6 has a wide, flat base which allows for quickly and easily rolling the excess strap 16 without slipping, unlike a more rounded roller. A slit within the roller could be included, the slit receiving the backpack strap and retaining a portion of it within the roller, but such a slit is not required.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A backpack strap spool apparatus comprising:

a roller configured to receive and roll up a portion of a backpack strap, said roller comprising a flat, rigid surface configured for placement against a flat face of said backpack strap;

said roller body having a first end and a second end, said first end comprising a first tab and said second end comprising a second tab, each of said first and second tabs being spherical and permanently affixed to said first and second ends;

a loop comprising a plurality of holes, wherein a first one of said plurality of holes is configured for receiving said first tab and a second one of said plurality of holes is configured for receiving said second tab such that said roller is pivotally connected to said loop and is capable of being manually rotated about an axis along said first and second tabs, thereby rolling up said backpack strap;

said first one of said plurality of holes held in place by the spherical said first tab;

said second one of said plurality of holes held in place by the spherical said second tab; and said loop thereby retaining said portion of said backpack strap against said roller.

2. The backpack strap spool apparatus of claim 1, wherein said plurality of holes are configured for receiving and storing an accessory.

3. A backpack strap spool system comprising:

a backpack comprising an arm loop with a strap configured for tightening and loosening said arm loop;

said strap comprising a flat face;

a backpack spool comprising a roller and a loop, said roller comprising a central portion and two end tabs, and said loop comprising a plurality of receiver holes, said backpack spool being completely disconnected from said backpack strap;

said roller configured to be placed against said flat face of said strap and rolled up within said strap, thereby forming a rolled strap;

a first of said plurality of receiver holes configured to be connected to a first of said two end tabs;

a second of said plurality of receiver holes configured to be connected to a second of said two end tabs such that said roller is pivotally connected to said loop and is capable of being manually rotated about an axis along said first and second tabs, thereby rolling up said backpack strap;

each of said first and second tabs being spherical and permanently affixed to said first and second ends; and whereby said loop restrains said strap against said roller, thereby preventing said strap from becoming unrolled.

4. The system of claim 3, further comprising:

said roller having a flat, rigid surface configured for placement against a flat face of said strap.

5. The system of claim 3, wherein said plurality of receiver holes are configured for receiving and storing an accessory.

6. A method of rolling a backpack strap, the method comprising the steps:

providing a backpack having an arm loop with a strap configured for tightening and loosening said arm loop;

providing a roller which is not affixed to said backpack strap;

placing said roller against a flat surface of an end of said strap;

rolling said strap up against said roller;

said loop comprising a plurality of receiver holes;

connecting a loop to said roller strap by inserting said tabs into respective receiver holes, said loop restraining said strap against said roller such that said roller is pivotally connected to said loop and is capable of being manually rotated about an axis along said first and second tabs and thereby preventing said strap from becoming unrolled; and securing said loop to said roller strap with said first and second tabs, whereby said first and second tabs being spherical and permanently affixed to first and second ends of said roller.

7. The method of claim 6, wherein said roller has a flat, rigid surface configured for placement against a flat face of said strap.

8. The method of claim 6, wherein said plurality of receiver holes are configured for receiving and storing an accessory.

* * * * *